US007455493B2

(12) United States Patent
Schoppe et al.

(10) Patent No.: US 7,455,493 B2
(45) Date of Patent: Nov. 25, 2008

(54) BALL PICKUP DEVICE

(75) Inventors: Terry L. Schoppe, Cedar Falls, IA (US); Scott M. Hottle, Waterloo, IA (US); Ron L. Saul, Cedar Falls, IA (US); Matthew L. Hurley, Cedar Falls, IA (US); Greg L. Boyer, Cedar Falls, IA (US); Monty G. McFarlane, Cedar Falls, IA (US); Patrick J. Trepp, Cedar Falls, IA (US)

(73) Assignee: Standard Golf Company, Cedar Falls, IA (US)

( * ) Notice: Subject to any disclaimer, the term of this patent is extended or adjusted under 35 U.S.C. 154(b) by 408 days.

(21) Appl. No.: 11/182,130

(22) Filed: Jul. 15, 2005

(65) Prior Publication Data

US 2007/0031223 A1 Feb. 8, 2007

(51) Int. Cl.
*B60P 1/00* (2006.01)

(52) U.S. Cl. ..... 414/440; 56/328.1

(58) Field of Classification Search ..... 414/440, 414/434; 56/328.1
See application file for complete search history.

(56) References Cited

U.S. PATENT DOCUMENTS

| | | | | |
|---|---|---|---|---|
| 2,658,637 | A | 11/1953 | Bailey | |
| 2,810,487 | A | 10/1957 | Bailey | |
| 3,102,647 | A * | 9/1963 | Bonney | 414/440 |
| 3,175,714 | A | 3/1965 | Wittek | |
| 3,362,551 | A | 1/1968 | Schoemaker | |
| 3,613,341 | A | 10/1971 | Reeves | |
| 3,744,225 | A | 7/1973 | Reeves | |
| 5,149,245 | A * | 9/1992 | Landmann | 414/440 |
| 5,882,169 | A | 3/1999 | Tucek | |
| 6,219,845 | B1 * | 4/2001 | Ferriter | 2/24 |

* cited by examiner

*Primary Examiner*—Charles A Fox
(74) *Attorney, Agent, or Firm*—McKee, Voorhees & Sease, P.L.C.

(57) ABSTRACT

A ball pickup device includes a plurality of gang assemblies for pivotal movement about a vertical axis. One of the gang assemblies is positioned at the forward end of the device and includes a float wheel which bears a major portion of the weight of the assembly. This facilitates turning, maneuvering, and wear of the various discs that are included in each gang assembly for picking up balls.

4 Claims, 5 Drawing Sheets

BALL PICKUP DEVICE

BACKGROUND OF THE INVENTION

The present invention relates to a ball pickup device.

Range ball pickup devices are utilized on driving ranges and practice ranges throughout the world to collect and retrieve balls hit by golfers on these ranges. Traditionally the ball pickup devices are made of several sections of discs assembled into disc gangs. These gangs of semi-flexible discs are attached to a main frame. As the gangs are propelled over the terrain, the range balls are picked up by being squeezed between the discs. The balls are dislodged from between the discs by a series of tines and deposited into baskets. A push bar attachment is used to propel the entire assembly across the range.

There are several disadvantages of present ball pickup devices. Generally the ball pickup devices are arranged in a triangular shape with a front disc gang positioned at the front of the device. A golf cart or other vehicle is used to push the device in the direction of the front disc gang.

In some examples of prior art there is a support tire located well in front of the front gang. This increases the length of the overall machine. It also forces the front tire assembly to cantilever in front of the entire unit increasing the stress on the wheel assembly. It forces the front wheel assembly to act as a bumper when the unit is in use. Using these forward guide wheels force the front tire to drive over and embed balls into the turf. This makes picking the balls up impossible.

When the front guide wheel is extended forward of the front gang it is vulnerable to striking solid objects on the range. This renders the machine inoperable until repairs are made. The forward wheel assembly is also the most difficult area for the inexperienced operator to judge.

Some prior art utilizes no front wheel at all. These designs put significant stress on the discs and make the entire unit less maneuverable.

Another problem encountered with prior art ball pickup devices is the difficulty in turning the ball pickup device. Because the discs are attached to one another across the entire width of the disc gang, they are difficult to turn and often result in dragging or cutting of the turf during the turning action.

Also, the prior art devices are difficult to back up, and therefore are difficult to maneuver in close places such as a garage or other enclosures.

Therefore, a primary object of the present invention is the provision of an improved ball pickup device.

A further object of the present invention is the provision of a ball pickup device that has a float wheel located adjacent the front disc gang for supporting the discs partially and for bearing the major portion of the weight of the disc gang.

A further object of the present invention is the provision of a float wheel that permits the turning of the front disc gang on the float wheel rather than on the discs themselves.

A further object of the present invention is the provision of a disc gang that will operate even if the front float wheel goes flat.

A further object of the present invention is the provision of an improved ball pickup device having the ability to operate in a reverse direction for maneuverability.

A further object of the present invention is the ability of the front gang as well as the other disc gangs to pivot 360 degrees about a vertical axis.

A further object of the present invention is the provision of an improved ball pickup device which keeps the discs on the ground in irregular terrains.

A further object of the present invention is the provision of an improved ball pickup device that has improved longevity due to the fact that the discs do not wear as much as in prior art devices.

A further object of the present invention is the provision of a float wheel that supports the discs, and bears a major support of the disc gang.

A further object of the present invention is the provision of a ball pickup device having improved turning ability.

A further object of the present invention is the provision of an improved ball pickup device that includes a front ball deflector that is adaptable to varying terrains and minimizes digging into the ground.

A further object of the present invention is the provision of a ball pickup device which is economical to manufacture, durable in use, and efficient in operation.

BRIEF SUMMARY OF THE INVENTION

The foregoing objects may be achieved with a ball pickup device driven by a prime mover for picking up a plurality of balls on a supporting surface. The ball pickup device comprises a frame adapted to be operatively connected to the prime mover. A gang assembly is operatively connected to the frame and comprises a basket, a plurality of tines, and a plurality of flexible discs mounted to the frame for rotation about a substantially horizontal disc axis. Each of the plurality of flexible discs includes an outer circular edge that rests upon and rolls upon the supporting surface. A plurality of disc spaces are provided between the adjacent discs. The disc spaces are dimensioned and the flexibility of the discs is chosen so that at least some of the plurality of discs engage and retain each of the plurality of balls in the disc spaces while the discs are on the supporting surface. The basket is mounted adjacent the plurality of flexible discs. Each of the tines extend into one of the disc spaces for engaging the balls retained therein and for causing the balls to be removed and deposited into the basket. A float wheel is mounted to the forward gang assembly for rotating on the supporting surface about a substantially horizontal wheel axis parallel to the disc axis. The float wheel is positioned to bear a portion of the weight of the gang assembly in combination with the plurality of discs.

According to another feature of the present invention the position of the float wheel relative to the plurality of discs causes a greater amount of the weight of the gang assembly to be borne by the float wheel than by the plurality of discs while at the same time causing the plurality of discs to engage the supporting surface.

According to another feature of the present invention, a plurality of gang assemblies is mounted rearwardly of the forward disc assembly.

According to another feature of the present invention the gang frame is connected to the frame of the ball pickup device for pivotal movement about a vertical gang axis.

According to another feature of the present invention, one of the plurality of gang assemblies is positioned forward of the remaining gang assemblies, and the wheel is mounted on the one gang assembly and is not part of the remaining gang assemblies.

According to another feature of the present invention, the plurality of discs that comprise the gang assembly are subdivided into a plurality of disc groups. Each of the disc groups is rotational independently of the other disc groups about the disc axis.

According to another feature of the present invention the float wheel is mounted to a float wheel frame and the discs are mounted to a disc frame. A universal joint connects the float wheel frame to the disc frame for pivotal movement about first and second pivotal axes that are perpendicular to one another.

According to another feature of the present invention, a first disc wheel and a second disc wheel are mounted in space relation to one another for rotation about the horizontal disc axis, and engage the supporting surface to bear a portion of the weight of the gang assembly on the supporting surface.

DETAILED DESCRIPTION OF THE PREFERRED EMBODIMENT

Figure 1:
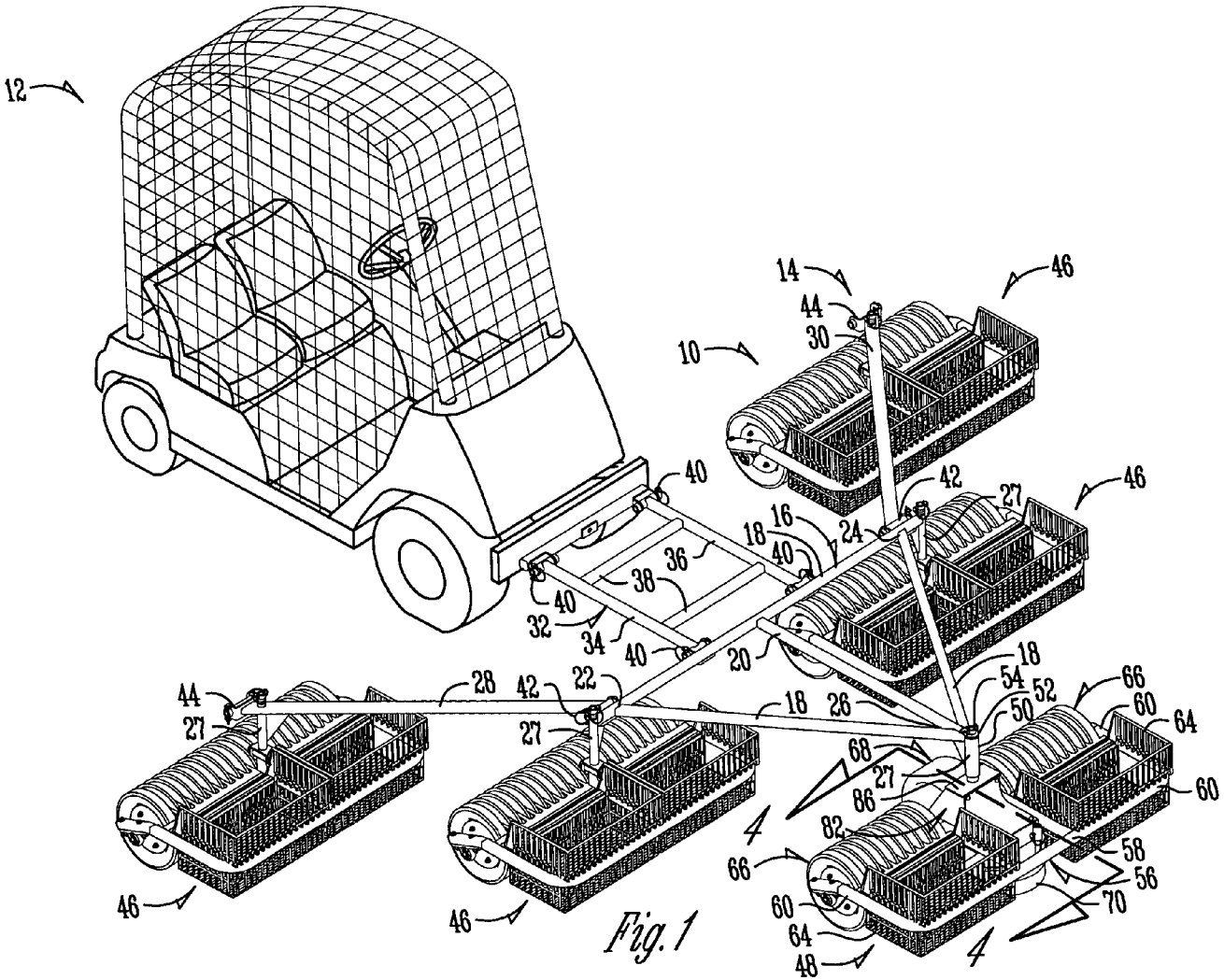
FIG. 1 is a perspective view of the ball pickup device of the present invention.

Referring to FIG. 1, a ball pickup device 10 is shown. Ball pickup device 10 is shown attached to a vehicle 12 which is adapted to push the ball pickup device to the right as viewed in FIG. 1.

The ball pickup device includes a frame 14. Frame 14 includes at its front a triangular frame 16 comprised of three triangular frame members 18 and a strut frame member 20 which provides reinforcement. The triangular frame 16 includes three points 22, 24 and 26. At each of the three points 22, 24, 26 is a vertical sleeve 27 which is welded to the frame 14.

Figure 4:
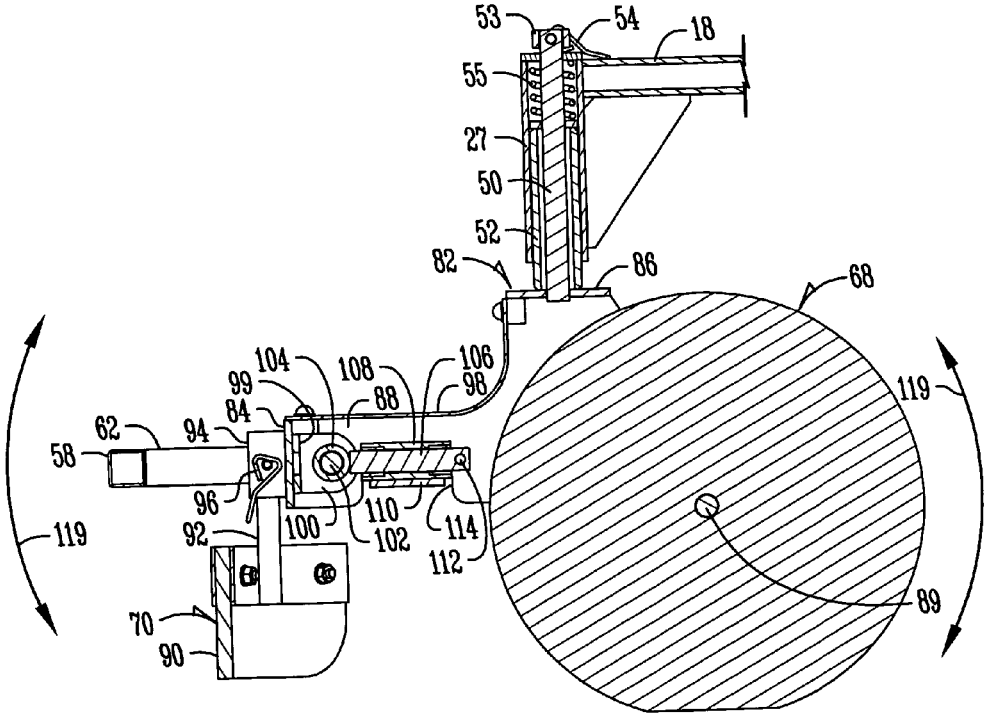
FIG. 4 is a sectional view taken alone line 4-4 of FIG. 1. downwardly declining support surface.

Extending rearwardly from the points 22, 24 are a pair of wing frame members 28, 30 respectively. Connected to the rear-most triangular frame member 18 is a pushing frame 32 which comprises two side members 34, 36 and two cross members 38. Connected to each end of the side frame members 34, 36 are pushing frame devises and pins 40. The clevis and pins 40 permit the pushing frame 32 to pivot about its connection to the triangular frame 16 and also to pivot about its connection with the vehicle 12. A pair of wing devises 42 are connected to the points 22, 24 of the triangular frame 16 so as to connect the frame members 28, 30 thereto. Rear wing devises 44 are provided on the rear ends of the wing frames 28, 30 for adding additional disc gang assemblies 46 to the pickup device 10. Rear gang assemblies 46 are pivotally attached to the points 22, 24 by vertical sleeves 27 for pivotal movement about a vertical axis. A front gang assembly 48 is attached at the forward most point 26 of the triangular frame 16 for pivotal movement about a vertical axis provided by the sleeve 27. The front gang assembly differs in that it includes a float wheel 68, whereas the rear gang assemblies 46 do not include the float wheel 68. The front gang assembly 48 includes a front pivot pin 50 (FIG. 4) which is welded to a rear plate 86 on a U-shaped float wheel frame 82. Welded to the pivot pin 50 is a sleeve stop 52. A clasp 54 holds a ring stop 53 to the upper end of pivot pin 50. A spring 55 is compressed between the inner end of sleeve 27 and the sleeve stop 52. This permits the pivot pin 50 to spring upwardly within sleeve 27. This arrangement causes the float wheel 68 to constantly engage the ground while at the same time providing a floating motion to the float wheel 68 as it rides on various irregular terrain.

Figure 2:
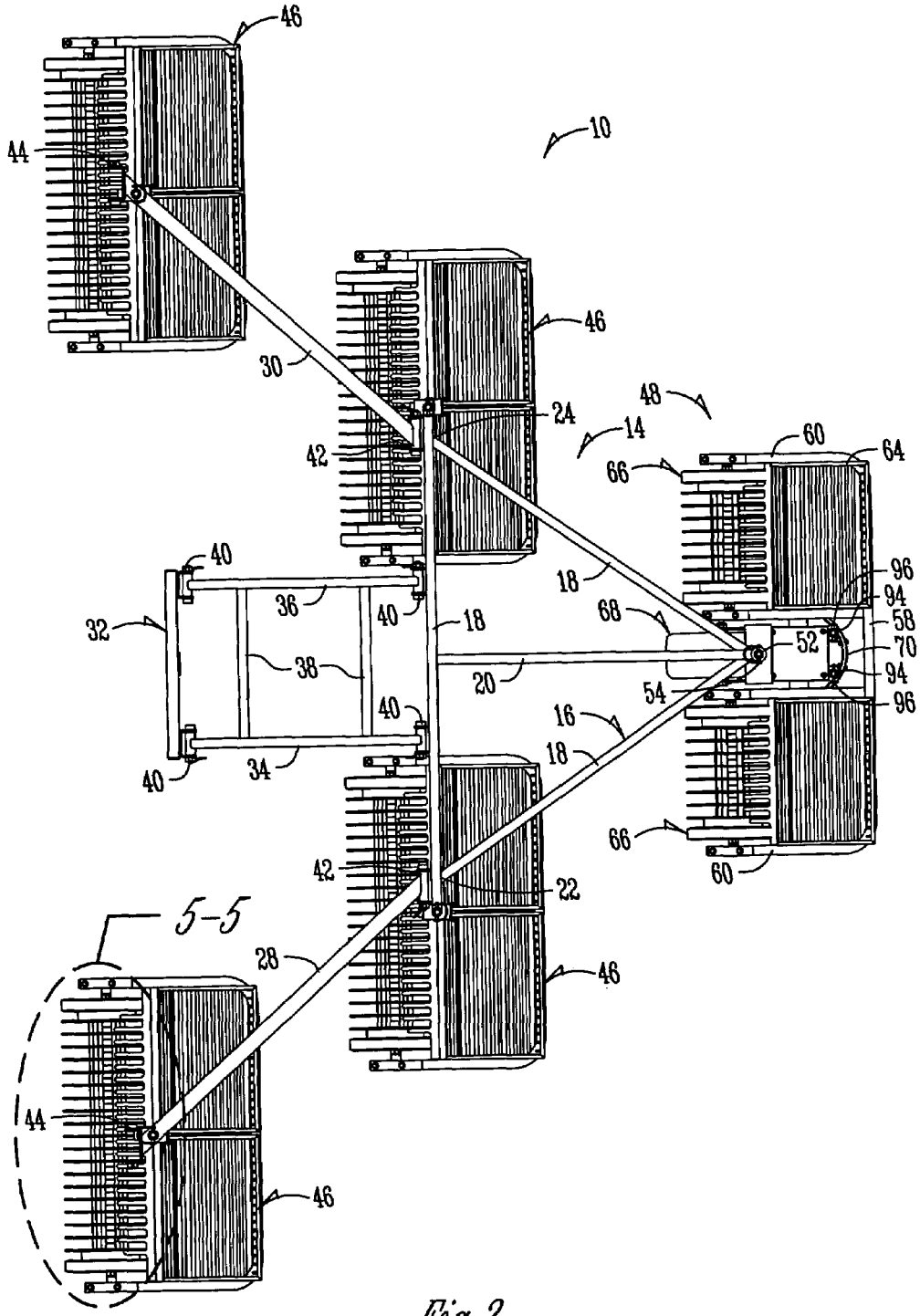
FIG. 2 is a top plan view of the ball pickup device shown in FIG. 1.
Figure 3:
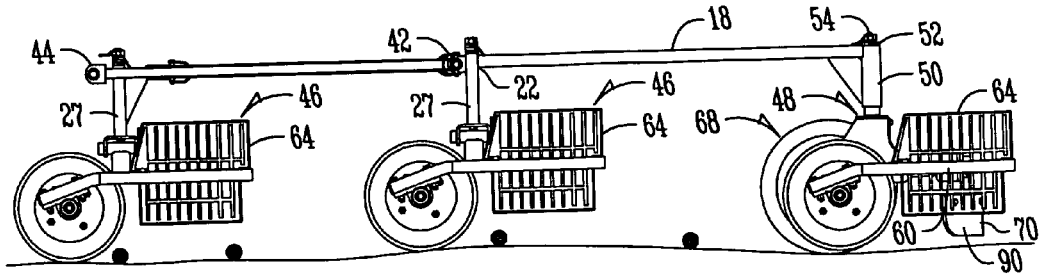
FIG. 3 is a side elevational view of the ball pickup device of the present invention.

The front gang assembly 48 also includes a front disc frame 56 which includes a cross frame member 58 and two opposite end frame members 60 which extend rearwardly there from. Central frame members 62 (FIG. 6) extend rearwardly also from front cross frame member 58. Baskets 64 are positioned forwardly of the front disc assemblies 66 as shown in FIGS. 1, 2 and 3. Baskets 64 are not shown in FIGS. 4-6 in order to show other features of the invention.

The ball deflector 70 is mounted to a front plate 84 at the front of U-shaped float wheel frame 82. The float wheel 68 is pivotally mounted on a float wheel axle 89 which extends between two rearwardly extending side plates 88 of the U-shaped float wheel frame 82.

Figure 6:
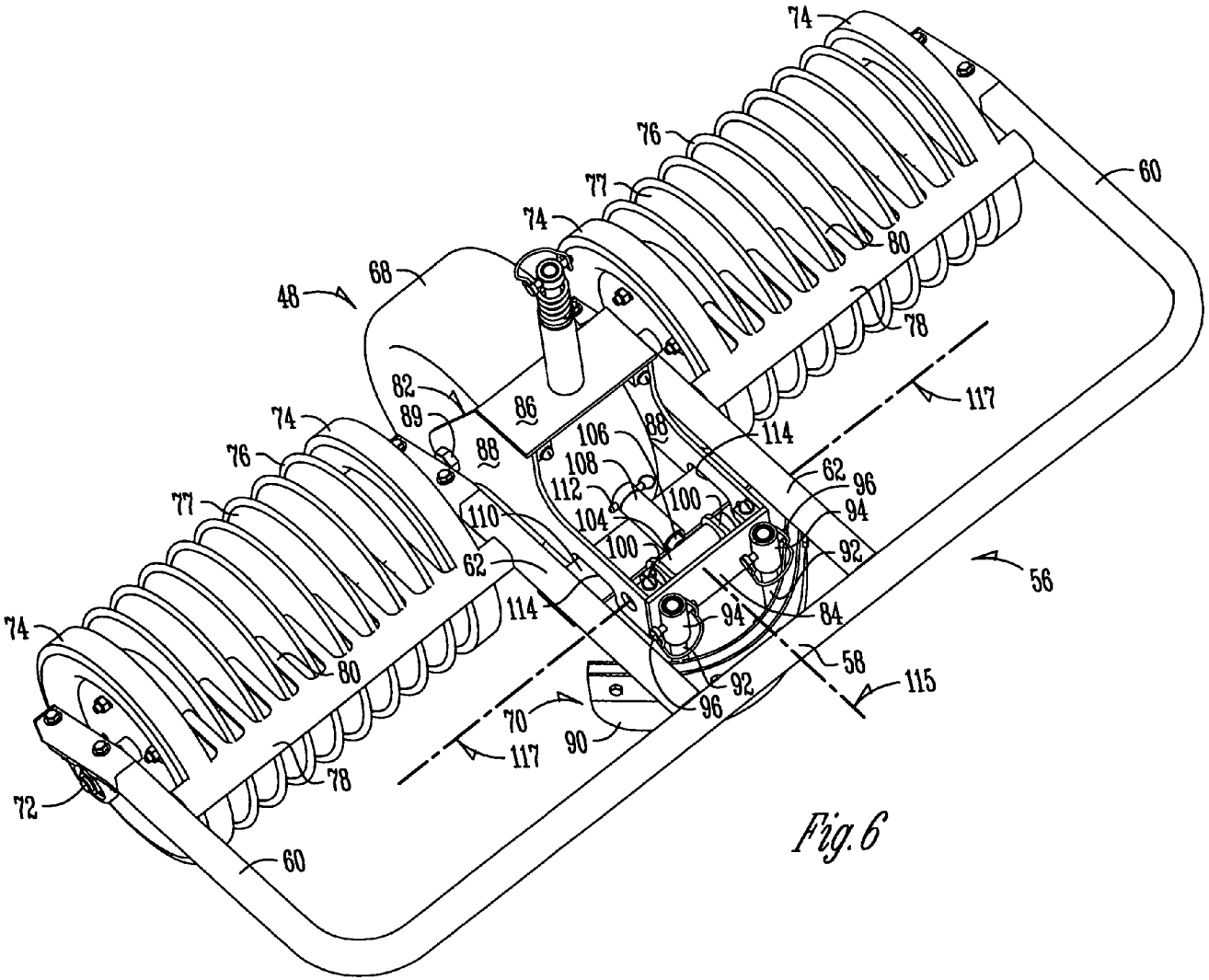
FIG. 6 is a perspective view of the front disc gang of the present invention, showing a portion of the U-shaped member removed to reveal the inner workings thereof.

Referring to FIG. 6, a pair of front disc wheels 74 are mounted on the front disc axle 72 at opposite ends thereof. As can be seen in FIG. 6, there are two disc sections, and four front disc wheels 74. Each of the disc wheels 74 is positioned at the end of the disc axles. A plurality of discs 76 are mounted in spaced relation to one another between two of the disc wheels 74. Disc wheels 74 are rigid in construction, preferably made from hard rubber that is solid. They are of approximately the same diameter as the discs 76. The discs 76 are flexible in nature and adapted to spread apart in response to engaging a ball there between. The disc spaces 77 between each of the discs 76 are spaced slightly less than the diameter of the balls being grasped. Thus the flexibility of the discs 76 together with dimensions of the disc spaces 77 permit the discs to flex slightly in response to encountering the ball so that they squeeze the ball there between and grasp it.

A tine crossbar 78 is provided on each side of the float wheel 89. The tine crossbars each include tines 80 which extend within the disc spaces 77. The tines 80 engage the golf balls and cause them to be deflected and removed from between the discs 76 and dumped into the baskets 64.

The ball deflector plate 90 is a curved plate that deflects the balls on the ground so that the balls engage the discs 76 and are not encountered by the float wheel 89. Preferably the ball deflector plate 90 is made from rubber to minimize digging into the turf. The ball deflector 90 is mounted by means of vertical ball deflector rods 92 and sleeves 94 and pins and clips 96 to the front plate 84 of U-shaped frame 82.

Attached to the rearward surface of front plate 84 and extending rearwardly there from is a clevis 99 having a pair of ears 100 which are spaced apart from one another. Ears 100 include a pivot pin 102 (FIG. 4) extending there between. A T-sleeve 104 is rotatably mounted over this pivot pin 102. T-sleeve 104 is welded to a T-pivot pin 106 which extends rearwardly there from. T-pivot pin 106 is rotatably mounted within a pivot sleeve 108 which in turn is welded to a cross plate 110. The ends of cross plate 110 are welded to the two central frame members 62 of front disc frame 56. A pin and clamp assembly 112 secure T-pivot pin 106 within the pivot sleeve 108. The side plates 88 of U-shaped member 82 are provided with notches 114 and the cross plate 110 fits within these notches 114 and is welded at its opposite ends to central frame members 62.

The result of T-pivot pin 106 and T-sleeve 104 being welded to one another is to create a T-shaped knuckle or universal joint formed by these two components. The T-universal joint provides pivotal movement of the disc frame 56 with respect to the U-shaped float frame 82 about a longitudinal axis 115 (FIG. 6) extending through pin 106 and also about a second perpendicular axis 117 extending through pin 102. This permits the disc frame 56 to tilt about axis 115 with respect to the U-shaped frame 82 in response to encountering various terrains, and also permits disc frame 56 to pivot on axis 117 with respect to float frame 82. The pivoting action about axis 117 is illustrated by arrows 119 in FIG. 4. This tilting action insures that float wheel 68 and the discs 76 stay in contact with the ground regardless of the type of terrain encountered.

Figure 5:
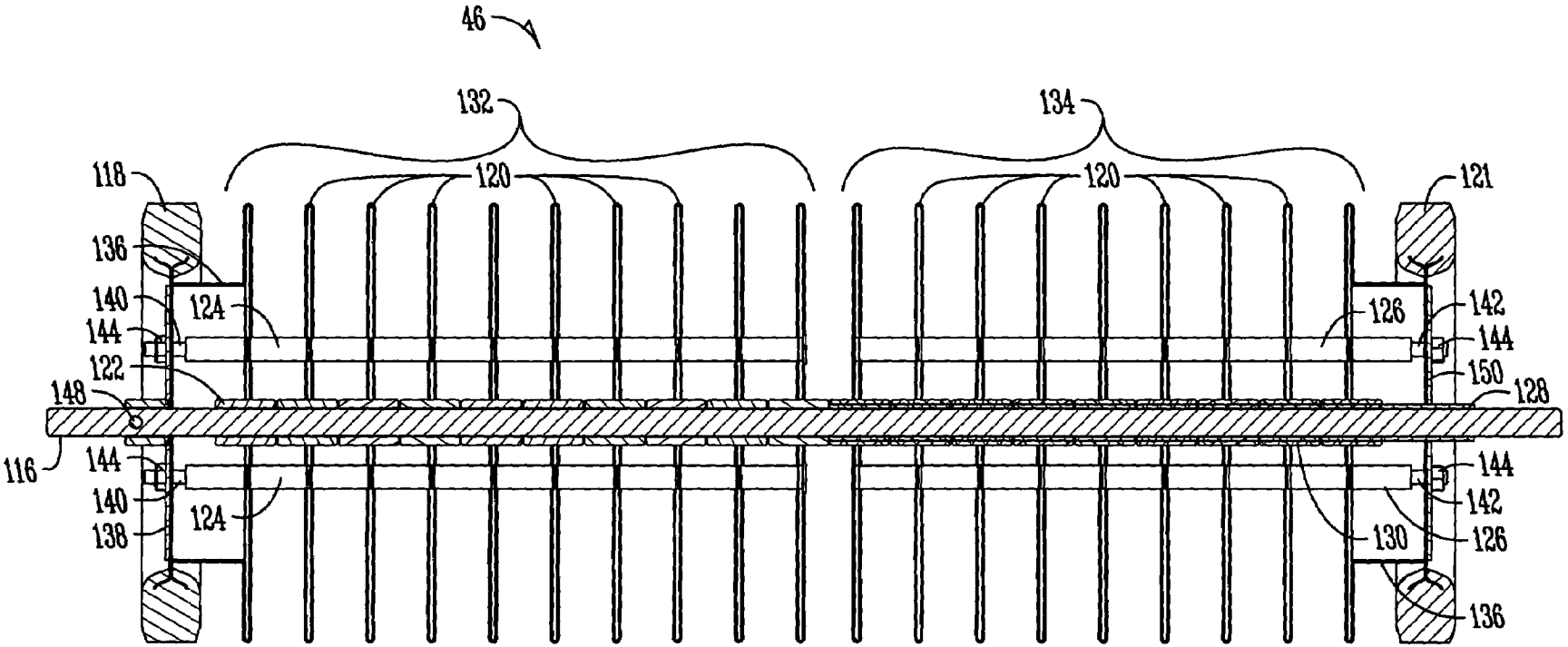
FIG. 5 is an enlarged top plan view taken along line 5-5 of FIG. 2.

Referring to FIG. 5, the rear gang assemblies 46 are shown. An axle shaft 116 extends throughout the disc gang 46. Mounted at the opposite ends of axle shaft 116 are two disc wheels 118, 121. These disc wheels 118, 121 are of the same construction as disc wheels 74 shown in FIG. 6. The disc wheels 118, 121 are preferably made of a hard material such as rubber, partially filled with air. They are harder than float wheel 68. Mounted upon the shaft 116 between the wheels 118, 121 are a plurality of discs 120 which are divided into the two disc groups 132, 134. These discs 120 are of the same or substantially the same diameter as wheels 118, 121 and are of the same construction as front discs 76. They are made of a flexible material so they can flex toward and away from one another. The flexible material is conventionally known in the art.

The first group 132 of discs 120 is operatively connected to the shaft 116 for rotation therewith. This is accomplished by disc bearings 122 which are located at the center of each disc 120 and which are mounted for rotation about the shaft 116. Each of the discs 120 in group 132 are connected by a first tie rod sleeve 124 having a first tie rod 140 extending there through. The tie rods 140 have heads (not shown) at the center of FIG. 5 and include threaded ends upon which are threaded nuts 144. Nuts 144 engage a hub plate 138 so as to secure all of the wheel 118 and discs 120 together in unison. Wheel 118 is fixed to shaft 116 by means of a bolt or pin 148. Thus shaft 116, wheel 118, and discs 120 all rotate in unison with the shaft 116 and are fixed thereto.

In contrast, the second group 134 of discs 120 of group 134 are rotatably mounted for rotation on shaft 116. An axle sleeve 128 is mounted on axle 116. Each disc 120 includes a disc bearing 130 which is mounted for rotation about sleeve 128.

Extending through discs 140 of group 134 is a second tie rod sleeve 126 having a second tie rod 142 extending there through. Tie rod 142 includes a head (not shown) similar to the head provided by first tie rod 140. This head engages the central disc 120 and urges all the discs 120 in group 134 to the right. The second tie rod 142 includes a threaded end on which is bolted a nut 144. Nut 144 engages the hub plate 150 of the right wheel 121. Spacers 136 maintain the wheels 118, 121 in spaced relation to the discs 120.

In assembly, the group 132 and the wheel 118 are attached to the shaft 116. Then the group 134 of disc 120 and the right wheel 121 are slid upon the axle 118. It should be noted that the second group of discs 134 and the wheel 121 are independently rotatable on the shaft 116 and are not fixed to the shaft 116. However, the disc 120 of group 134 rotate in unison due to the inter connection of the second tie rod sleeves 126 and the tie rods 142.

This is an important feature for the turning of the device. If the ball pickup device is turned and the discs 120 are all fixed to shaft 116, there is a gouging of the terrain and skidding of the discs during the turning action. However, by dividing the discs into two or more groups such as group 132, 134, it is possible to cause the two or more groups to rotate independently of one another and consequently the turning action is easier. The turning action is also facilitated by wheels 118, 121 which bear a substantial portion of the weight of the rear gang assemblies 46.

In the front gang assembly 48 the turning action is also facilitated by virtue of the fact that the float wheel 68 and the disc wheels 74 are mounted thereon. The float wheel 68 and the disc wheels 74 bear most of the weight of front gang assembly 48. The discs 76 are in engagement with the ground, but float primarily on the ground and do not bear a substantial amount of the weight. The disc wheels 74 and the float wheel 68 bear a major portion of the weight thereby minimizing the amount of weight born by the various discs. This results in less wear on the discs 76 throughout extensive use. It also permits easier turning of the device since the discs do not bear a major portion of the weight in the front gang assembly 48.

Another feature of the present invention is the vertical axis by which each gang assembly 46, 48 is mounted to the frame 14. The vertical axis is provided by sleeves 27, and permits each gang assembly 46, 48 to pivot about this vertical axis during turning. The gang assemblies 46, 48 are free to rotate 360 degrees about this vertical pivotal axis.

Another feature of the present invention is the ability to reverse the direction of pushing or pulling of the ball pickup device 10. Normally the device is pushed in the manner shown in FIG. 1. However, for storage and in difficult to maneuver places, it may be necessary to reverse the movement of the vehicle so as to pull the ball pickup device 10 to maneuver it out of or into various positions. The pivotal action of gang assemblies 46, 48 about the vertical axes provided by sleeves 27 together with the float wheel 68 and the disc wheels 74, 118, further facilitate this ability to reverse the direction. Thus the device provides substantial improvement in maneuverability.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. A ball pickup device driven by a prime mover for picking up a plurality of balls on a supporting surface, the ball pickup device comprising:

a frame having a rear end operatively connected to the prime mover and a forward end located forwardly from the rear end;

a plurality of gang assemblies operatively connected to the frame and comprising a basket, a plurality of tines, and a plurality of flexible discs mounted to the frame for rotation about a substantially horizontal disc axis;

each of the plurality of flexible discs having an outer circular edge that rests and rolls upon the supporting surface;

a plurality of disc spaces between adjacent ones of the plurality of discs, the disc spaces being dimensioned and the flexibility of the discs being chosen so that at least some of the plurality of discs engage and retain each of the plurality of balls in the disc spaces while the discs are rolling on the supporting surface;

the basket being mounted adjacent the plurality of flexible discs;

each of the plurality of tines extending into one of the disc spaces for engaging the balls retained therein and for causing the balls to be removed and deposited into the basket;

one of the plurality of gang assemblies being positioned forward of the other of the plurality of gang assemblies;

a float wheel mounted to the one gang assembly for rotating on the supporting surface about a substantially horizontal wheel axis parallel to, or coincident with, the disc axis, the float wheel and the plurality of discs engaging and rolling upon the support surface;

a float, wheel frame mounted to the float wheel;

a disc frame mounted to the plurality of disks; and a universal joint connecting the float wheel frame and the disc frame for pivotal movement about a first pivotal axis and a second pivotal axis being perpendicular to the first pivotal axis.

2. The ball pickup device according to claim 1 wherein the plurality of discs is subdivided into a plurality of disc groups, each of the disc groups rotating independently from one another about the disc axis.

3. The ball pickup device according to claim 2 wherein a plurality of tie members each connect one of the plurality of disc groups together for rotation about the disc axis is unison.

4. The ball pickup device according to claim 3 wherein a first disc wheel and a second disc wheel embrace each of the discs there between in each of the gang assemblies, the first and second disc wheels being mounted for rotation about the disc axis and engaging the supporting surface.

* * * * *